United States Patent [19]

Hanson

[11] Patent Number: 4,702,659

[45] Date of Patent: Oct. 27, 1987

[54] BACKING FOR BINDING SHEETS

[75] Inventor: Gary R. Hanson, Minneapolis, Minn.

[73] Assignee: Minnesota Mining and Manufacturing Company, Saint Paul, Minn.

[21] Appl. No.: 864,528

[22] Filed: May 19, 1986

[51] Int. Cl.[4] ..... B42D 3/00; B42C 11/00

[52] U.S. Cl. ..... 412/4; 281/29; 281/15 R; 281/35; 281/37

[58] Field of Search ..... 412/4; 281/15 R, 15 A, 281/15 B, 29, 34, 35, 37; 156/90, 227, 291, 486, 508, 908

[56] References Cited

U.S. PATENT DOCUMENTS

| | | | |
|---|---|---|---|
| 848,680 | 4/1907 | Nelson . | |
| 1,765,194 | 6/1930 | Von Auw . | |
| 1,913,969 | 6/1933 | Wood . | |
| 2,014,305 | 9/1935 | Alger . | |
| 3,088,754 | 5/1963 | Burgmer | 282/22 |
| 3,179,967 | 4/1965 | Yohn et al. | 11/1 |
| 3,188,114 | 6/1965 | O'Brien et al. | 281/21 |
| 3,206,225 | 9/1965 | Oleson | 281/29 |
| 3,210,093 | 10/1965 | Steidinger | 281/21 |
| 3,825,963 | 7/1974 | Abildgaard et al. | 11/1 |
| 3,833,244 | 9/1974 | Heimann | 281/21 |
| 4,007,950 | 2/1977 | Giulie | 281/25 |
| 4,106,148 | 8/1978 | Axelrod | 11/1 |
| 4,213,220 | 7/1980 | Lopez-Martinez | 11/1 |
| 4,447,481 | 5/1984 | Holmberg | 428/40 |
| 4,511,298 | 4/1985 | Jones | 412/34 |
| 4,518,296 | 5/1985 | Pearson et al. | 412/37 |
| 4,537,544 | 8/1985 | Joost | 412/900 |
| 4,590,109 | 5/1986 | Holmberg | 428/40 |

FOREIGN PATENT DOCUMENTS

| | | |
|---|---|---|
| 0110237 | 6/1984 | European Pat. Off. . |
| 2815649 | 10/1979 | Fed. Rep. of Germany . |

*Primary Examiner*—Paul A. Bell

*Attorney, Agent, or Firm*—Donald M. Sell; James A. Smith; John C. Barnes

[57] ABSTRACT

Loose pages can easily be bound in a cover having a strip of aggressive pressure sensitive adhesive near the fold line by aligning the pages with the outer edge and then rolling the inner edge of the cover and pages to shingle the edges along the adhesive to attach each page.

10 Claims, 9 Drawing Figures

BACKING FOR BINDING SHEETS

BACKGROUND OF THE INVENTION

1. Field of the Invention

The present invention relates to a backing and a process for binding a plurality of loose pages together and provides a flap for assisting in the register of the sheets with the binding adhesive and permits a cover to be secured to the backing over the pages.

2. Description of the Prior Art

The backing for binding loose pages according to the present invention provides an improvement over backings for binding sheets which utilize a hot melt adhesive wherein the sheets to be bound are placed in a cover having a cover portion and a backing portion joined by a spine, the inside portion of which has been coated with a heat activatable adhesive which will migrate into contact with the edges of the sheets such that upon subsequent cooling the adhesive will secure the sheets to the binding. Such devices require the use of a simple machine which will receive the backing and conduct heat through the backing to the adhesive. The similarity with the hot melt adhesive binding is that it permits the sheets bound at the edge by an adhesive to lay flat when the same are being read or reviewed. The essential difference however is that the pressure sensitive adhesive of the cover of the present invention permits the binding of the loose sheets without the need for any fixture, electrical power, or lapse time for heating and cooling the adhesive.

SUMMARY OF THE INVENTION

The present invention is directed to a backing for binding sheets together which backing includes a flap attached along the fold line of the backing or the backing is formed of a sheet of cover card stock which has a length which is at least equal to the length of the paper to be bound plus some marginal dimension if desired, and the width corresponds to the width of the paper to be bound plus the width of the binding adhesive along one marginal longitudinal edge at which a fold line connects the back panel to a flap which has a length corresponding to that of the backing and a width which is equal to the width of the band of binding adhesive adjacent the fold line and a narrow band of pressure sensitive adhesive is coated along the free edge of the flap for attachment of any desired additional cover member.

The band of binding adhesive and the band of adhesive for attaching the cover are each protected initially by a strip of release liner material which will be easily removed from the adhesive to expose the adhesive for binding. The binding adhesive is preferable an adhesive with good initial adhesion and preferably a value of at least fourteen (14) ounces per one-half inch or greater as measured by the Pressure Sensitive Tape Council (PSTC) "Quick Stick" test No. 5.

DESCRIPTION OF THE DRAWING

The present invention will be further described with reference to the accompanying drawing wherein.

DESCRIPTION OF THE PREFERRED EMBODIMENTS

Figure 1:
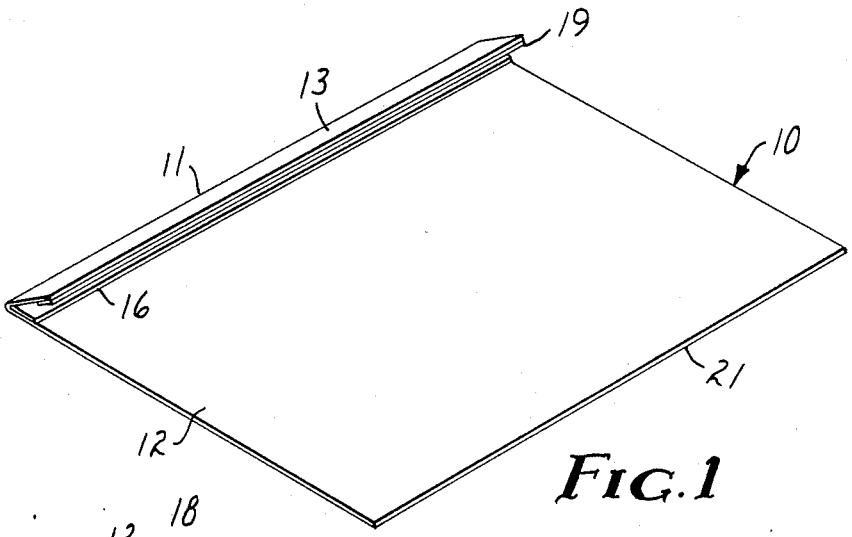
FIG. 1 is a perspective view of a cover according to the invention.
Figure 2:
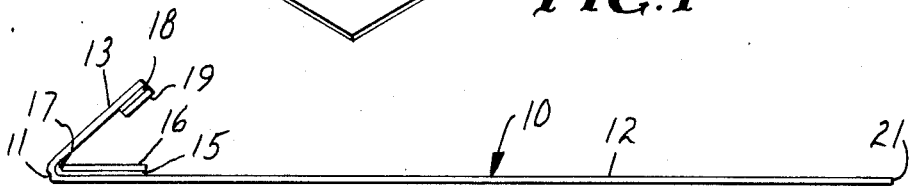
FIG. 2 is a side elevational view showing the backing and flap together with a better view of the adhesive coatings and release liners.
Figure 3:
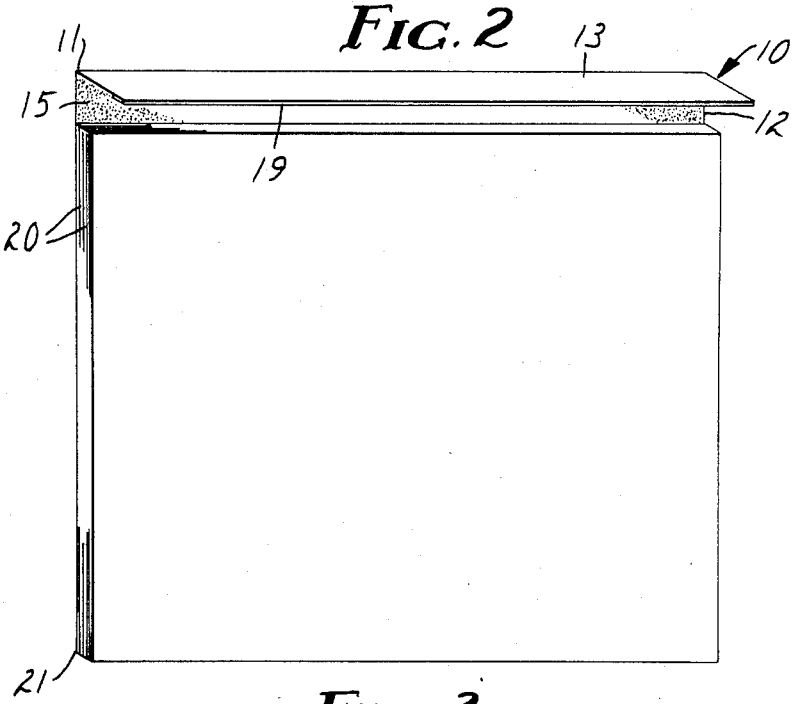
FIG. 3 is a view illustrating a step in the binding process showing pages and cover alignment.

Referring now to FIG. 1, the backing of the present invention is illustrated and comprises a sheet 10 of cover stock which is a paper composition having a caliper of about 0.011 inch, which sheet has been formed with a fold line 11 along one longitudinal edge to join the back portion 12 to a front flap 13 of the same longitudinal dimension but substantially narrower. The cover stock is flexible and has a stiffness or flexural rigidity as determined by the Technical Association of the Pulp and Paper Industry (TAPPI) Useful Methods test 409 of between $6\times10^{-3}$ and $5\times10^{-1}$ inch pounds. Such a material provides a backing which is flexible but yet has a stiffness to give a bound document sufficient rigidity to hold the pages and to be placed on a shelf.

A narrow band of pressure sensitive adhesive 15 is coated along a longitudinal edge of the back portion 12 adjacent the fold line 11. The adhesive extends slightly across the fold line and a release liner 16 covers the adhesive on the back portion 12. The adhesive is a very tacky adhesive which will contact the shingled edges of the sheets to be bound therein. A suitable adhesive for use with the binder is a normally tacky pressure-sensitive copolymer of iso-octyl acrylate and acrylic acid in a ratio of 95.5:4.5. The adhesive should have a "Quick Stick" value according to test number 5 of the PSTC (Pressure Sensitive Tape Council) of at least 10 ounces per 0.5 inch with a perferred value of at least 14 ounces per 0.5 inch width of adhesive. The flap 13 is folded in relationship to the back portion 12 at the score line 11. The score line 11 has a flexural rigidity of $3\times10^{-2}$ inch pounds.

The adhesive 15 extending beyond or slightly across the fold line 11, as illustrated at 17, will contact the surface of the liner opposite the surface portion contacting the adhesive 15. The free edge of the flap has a band of adhesive 18 coated on the inside surface, which adhesive is protected by a second release liner 19. The band of adhesive 18 is a narrow band of pressure sensitive adhesive to attach a paper of transparent film cover and it can be an adhesive similar to that adhesive 15.

The dimensions of the back portion 12 of the backing has a length which is dependent on the length of the sheets or pages 20 to be bound and is at least equal to the length pages to be bound. The total width of the sheet 10 is equal to the width of the back portion 12 which corresponds to the width of loose pages 20 to be bouhd plus an extended width including the width of the band of binding adhesive 15, and the width of the flap 13 minus the width of the band of adhesive to bind the back page or $\pi t$, where t is the thickness of the back page. The width of the binding adhesive is determined by the sum of the maximum number of pages to be bound plus 1 times the paper or page thickness (t) times pi ($\pi$). The flap 13 has a width corresponding to at least the width of the band of adhesive 18 plus pi times the thickness of a page to be bound but is less than $R_{min}$ (see FIG. 4) ($R_{min}$ is the minimum radius of the wrapped back portion 12 and pages before they strike the flap) which is given by the formula $$R_{min} = \frac{S}{2\pi} - tN_{max}$$

where S=the width of the back cover portion 12, t=the page thickness and $N_{max}$=the maximum number of pages. Thus, the total dimensions of the cover card stock sheet equals a length of pages to be bound and a width equal to the width of the pages plus the width of the adhesive band and the width of the flap.

The backing is preferably made for use in binding 10 to 25 sheets and includes a band of adhesive along the score line having a width equal to $$2t\pi(N_{max} + 1)\frac{X^\circ}{360^\circ}$$

(t equals the sheet thickness, X° equals the minimum degree of shingling or 180°, and $N_{max}$ equals the maximum number of pages to be bound).

Figure 4:
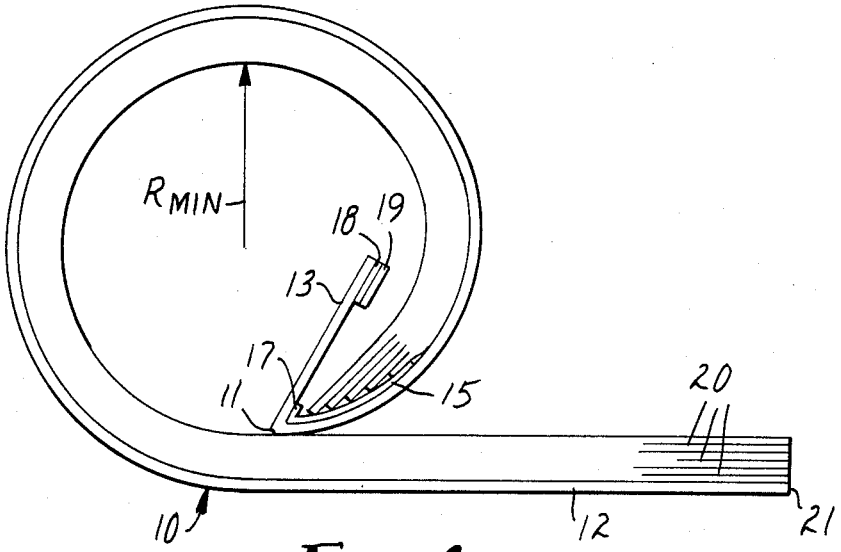
FIG. 4 is a side elevational view illustrating the wrapping of the cover during the binding process.
Figure 5:
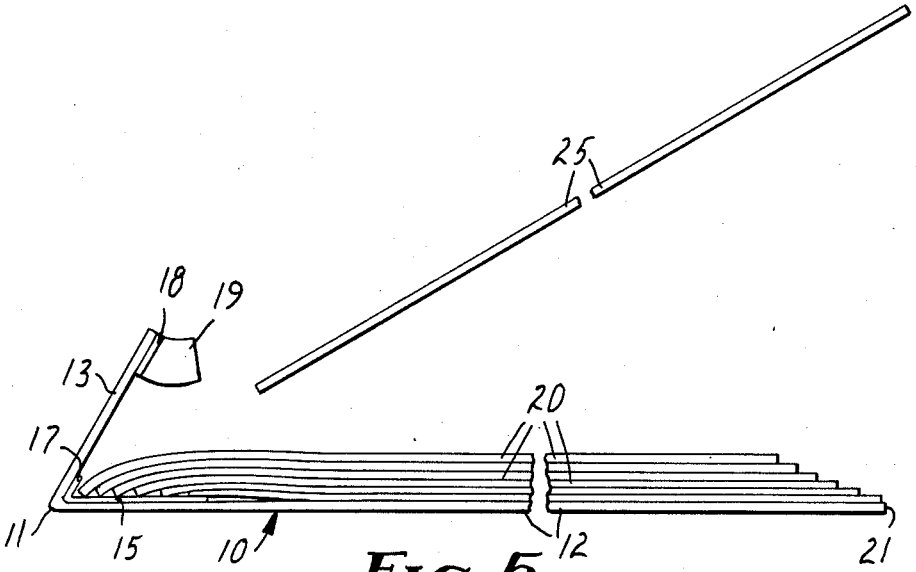
FIG. 5 is a side elevational view showing a further step of the binding process to attach the cover member.

In binding a plurality of loose pages 20 the same are bound by placing the loose pages in a stack, removing the release liner 16 from the adhesive 15, placing the loose sheets onto the back portion 12, and standing up the pages in the cover to jog the pages in the cover along the marginal longitudinal edge 21 of the back portion. The longitudinal edges of the sheets and the edge 21 are then clamped by the fingers and the flap and the opposite longitudinal edge of the sheets are then rolled back upon themselves, as illustrated in FIG. 4, to drive the pages toward the score line which rolling of the pages shingles the pages and exposes a margin of each page adjacent the opposite longitudinal edge, which margin and edge are then placed in contact with the adhesive 15. The amount of shingling is equal to;

$$\frac{2\pi tN(X^\circ)}{(360^\circ)}$$

where:

t=the page thickness

N=the number of pages

X=the degrees of cover wrap in performing the step illustrated in FIG. 4. A minimum cover wrap occurs at 180°.

The amount of shingling is limited by the curvature of the adhesive strip.

After the pages have been rolled with the cover and shingled against the band 15 of adhesive, the fingers clamping the pages adjacent edge 21 are released and the wrapped backing is allowed to open. A finger should then be run along the edges of the pages to press them more firmly against the adhesive 15. The flap may then be raised and the release liner 19 removed from the adhesive band 18. A cover 25 may then be placed upon the pages 20 and aligned as desired. The flap is then folded against the top surface of the cover 25 and the band of adhesive 18 will adhere the cover 25 in place on the flap 13.

Figure 6:
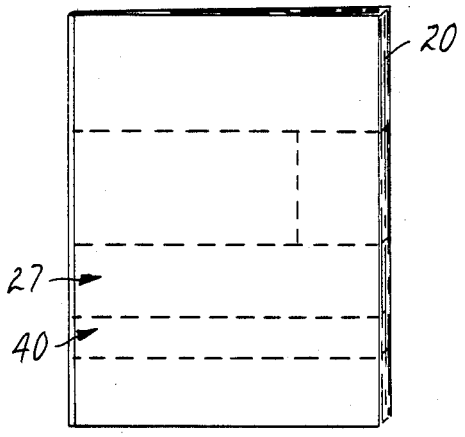
FIG. 6 is a perspective view of a bound document to be prepared for testing.
Figure 7:
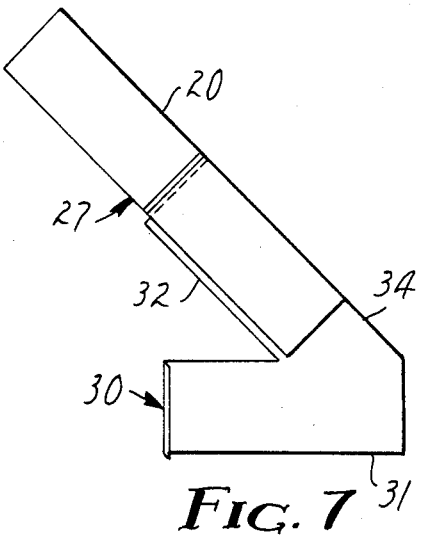
FIG. 7 is an elevational view of a test fixture.
Figure 8:
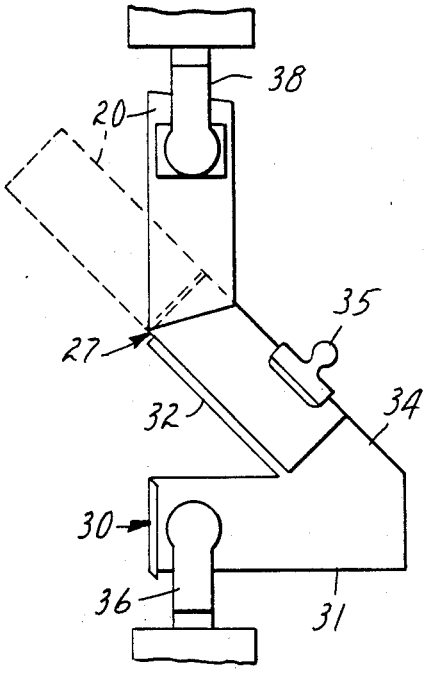
FIG. 8 is a fragmentary diagrammatical view of a test device, fixture and part of a document.
Figure 9:
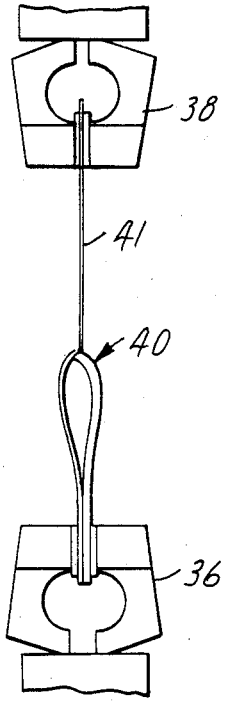
FIG. 9 is a fragmentary diagrammatical view of a test device and part of a document.

A bound document can be tested to determine whether the adhesive used provided an adequate binding for the sheets. The following test was established to assess the shear strength of a page to the binding adhesive when removed at a 45° angle. Referring to FIGS. 6, 7 and 8 the test is conducted as follows: using a paper cutter or guillotine the document booklet illustrated in FIG. 6 is first cut to provide a section 27 of the booklet 3 to 4 inches wide at the bound edge and 6 inches long. This cut section is then placed on a fixture 30 illustrated in FIG. 7, which fixture comprises a horizontally disposed portion 31 and an angled portion 32 disposed at 45° to the horizontally disposed portion 31. The document sample is opened to expose the third sheet 20 and the remaining pages and the sheet 20 are then clamped along the upper marginal edge 34 of the angled portion 32 by a suitable clamp 35. The horizontal portion 31 is then placed in the lower jaw 36 of an Instron tensile tester, available from Instron Corp., Canton, Mass., and the free end of the third sheet 20 is clamped in the upper jaw 38 of the Instron tensile tester. The Instron equipment is then calibrated to provide a crosshead speed of ten (10) inches per minute, the chart length set for ten (10) inches per minute, the gauge length is set to ten (10) inches, and the operator should use the Gram Cell at 1000 grams full scale. Jaw separation is then initiated as shown in FIG. 8 and the test results from the chart are recorded. Similar tests can be conducted with the sixth, ninth sheet, etc. Using 20 pound Bond paper that is shingled about 0.015 inch. An acceptable average value for this test of a booklet would be at least 40 grams with at least 70 grams and above being preferred.

Another test method is a 180° shear test to establish whether the adhesive has sufficient shear strength to a document page 20. This test is done on an Instron tensile tester after preparation of a booklet sample as illustrated in FIG. 6 wherein a one (1) inch wide sample 40 is cut from the finished booklet. Placing the top front page of the sample toward the operator positions the third strip 41 from the sample in the top jaw 38 of the Instron tensile tester and all of the remaining strips in the bottom jaw 36. Then calibrate the test equipment with a crosshead speed of 5 inches per minute, chart speed at 10 inches per minute, Gauge length at 5 inches and use the Gram Cell at 1000 grams full scale. Then initiate jaw separation and record the force to break the bond. This test can be repeated for the sixth, ninth or twelfth sheet, etc. Using 20 pound Bond paper sheets shingled 0.015 inch, acceptable values with this test are 400 grams per inch but values of 600 grams per inch and above are preferred.

Having thus described the present invention with reference to a preferred embodiment it is to be realized that modifications may be made without departing from the invention as defined in the appended claims.

I claim:

1. A backing for binding loose sheets of known length, width and thickness, said backing comprising:

a folded flexible sheet of stock having a length not less than said known loose sheet length;

said flexible sheet having a fold line dividing said sheet into a front portion and a back portion of unequal width;

said back portion having a longitudinal pressure-sensitive adhesive binding strip adjacent to said fold line and extending at least partially onto said front portion, said adhesive binding strip having a length not greater than the known loose sheet length;

said back portion having a width equal to or greater than the sum of the known loose sheet width plus the width ($A_W$) of said adhesive binding strip, which width ($A_W$) is determined by the formula:

$$A_W = 2t\pi(N_{max} + 1)\frac{X^\circ}{360^\circ}$$

wherein:

t=the loose sheet thickness

X°=the minimum degree of wrap of the loose sheets or 180°; and $N_{max}$=the maximum number of loose pages to be bound, said front portion having a longitudinal band of pressure-sensitive adhesive spaced from said fold line and being positioned along the free end of said front portion and having a given width, said adhesive binding strip and said band of adhesive being in contact with a release material, and said front portion having a width ($S_f$) defined by the formula:

$$S_f \leqq W_b + \pi t$$

but $S_f$ is not greater than $$S_f \leqq \frac{S}{2\pi} - tN_{max}$$

wherein:

$W_b$=the width of the longitudinal band of adhesive, t=the loose sheet thickness S=the width of the back portion $N_{max}$=the maximum number of loose pages to be bound.

2. A backing according to claim 1 comprising a sheet of stock having a flexural rigidity of between 0.006 inch-pounds and 0.05 inch-pounds.

3. A backing according to claim 2 comprising a sheet of paper card stock having a caliper of about 0.009 inch and an 80 pound (20×26 ream size) basis weight.

4. A backing according to claim 1 wherein said release material is a silicone liner with a release value between 10 and 25 grams per inch.

5. A backing according to claim 1 wherein in adhesive bending strip extends across the fold line onto the front portion.

6. A backing according to claim 1 wherein the fold line has a flexural rigidity of less than 0.03 inch-pounds.

7. A backing according to claim 1 wherein said adhesive bending strip has acceptable minmum adhesion values of:

Quick Stick=10 ounces per ½ inch, with a minimum preferred value of 14 ounces per ½ inch;

180° Shear=400 grams per inch, with a minimum preferred value of 600 grams per inch;

45° Peel=40 grams, with a minimum preferred value of 70 grams.

8. A backing according to claim 7 wherein said pressure-sensitive adhesive for said adhesive bending strip is a normally tacky pressure-sensitive copolymer of isooctyl acrylate/acrylic acid in a ratio of 95.5:4.5.

9. A method of binding together loose pages of paper of known length, with and thickness comprising the steps of:

selecting a cover having a front portion and a back portion of unequal width divided by a fold line and a length at least equal to the loose page length, said cover having a strip of pressure-sensitive adhesive along the fold line, said strip of adhesive having a width ($A_W$) determined by the formula:

$$A_W = 2t\pi(N_{max} + 1)\frac{X^\circ}{360^\circ}$$

wherein:

t=the loose page thickness

X°=the minimum degree of wrap of the loose sheets or 180°; and $N_{max}$=the maximum number of loose pages to be bound, and said back portions having a width equal to the width of the strip of adhesive plus the known page width, removing a release liner from the strip of adhesive, placing the loose pages to be bound in the cover aligning them to the free longitudinal edge of the back cover portion, jogging the cover and loose pages to be bound against a flat surface along the free longitudinal edge of the back cover portion, clamping the pages together along said free longitudinal edge, rolling the opposite edge of the pages and the backing toward said clamped edge, causing the unclamped longitudinal edge to become progressively shingled until the strip of adhesive is completely covered, pressing the ends of the rolled pages into contact with the strip of adhesive, and unrolling the cover and pressing the entire shingled edges of the pages into the strip of adhesive.

10. A method of binding loose pages according to claim 9 further comprising the step of removing the liner from the adhesive strip on the front portion and attach a separate front cover to said strip of adhesive.

* * * * *